United States Patent [19]

Thayer, III

[11] Patent Number: 4,980,609

[45] Date of Patent: Dec. 25, 1990

[54] SPARK GAP PURGE SYSTEM

[75] Inventor: William J. Thayer, III, Kent, Wash.

[73] Assignee: Amoco Corporation, Chicago, Ill.

[21] Appl. No.: 257,376

[22] Filed: Oct. 12, 1988

[51] Int. Cl.[5] ..... H01J 7/24

[52] U.S. Cl. ..... 315/111.01; 315/110; 315/112; 315/117; 315/326; 313/231.01; 313/231.21

[58] Field of Search ..... 315/50, 111.01, 112, 315/117, 108, 110, 326, 358, 150; 313/570, 637, 231.01, 231.21

[56] References Cited

U.S. PATENT DOCUMENTS

| | | | |
|---|---|---|---|
| 1,821,915 | 9/1931 | Pierce | 313/564 X |
| 2,819,427 | 1/1958 | Noskowicz | 313/358 X |
| 2,993,638 | 7/1961 | Hall et al. | 315/111.01 X |
| 3,480,829 | 11/1969 | Ornunm | 313/30 X |
| 4,237,404 | 12/1980 | Limpaecher | 315/111.01 |
| 4,755,719 | 7/1988 | Limpaecher | 313/597 |

*Primary Examiner*—Eugene R. LaRoche
*Assistant Examiner*—Do Hyun Yoo
*Attorney, Agent, or Firm*—Seed and Berry

[57] ABSTRACT

A spark channel purge system for high pulse repetition frequency spark gap switches. A purge fluid having a liquid state and a gaseous state is caused to flow through a spark gap channel, at least a portion of the purge fluid passing through the spark channel being in the gaseous state. The purge fluid is supplied in its liquid state by a purge fluid source. In some embodiments, the purge fluid source is a recirculating flow loop which includes a heat exchanger, while in another embodiment, the purge fluid source is a low-pressure liquid storage vessel. The heat exchanger transfers waste heat from the spark gap switch via the purge fluid flowing from the spark channel into the purge fluid supplied by the purge fluid source. This causes at least a portion of the liquid purge fluid to change to the gaseous state. In some embodiments, the spark channel purge system is suitable for a closed loop system, while other embodiments are suitable for an open loop system. In the two-phase flow loop embodiments, the two-phase purge fluid can be mixed to absorb energy from the spark gap switch.

22 Claims, 2 Drawing Sheets

SPARK GAP PURGE SYSTEM

DESCRIPTION

1. Technical Field

This invention relates to electrical switches, and more particularly, to two repetitively pulsed, gas purged spark gap switch systems.

2. Background Art

Spark gaps can operate as switches to control the flow of very large electrical currents under very high voltage conditions. Typical applications include accelerators, high-power gas laser systems, and other pulsed power systems. Spark gaps operate to prevent the flow of electrical current in high voltage applications by filling the space between a pair of electrodes with an insulating gas. When current flow is desired, a trigger pulse on an intermediate electrode or some other means is used to change the state of the insulating gas and thus create a more conductive path. The lower resistance locally leads to a rapid breakdown of the gas between the electrodes, which very rapidly produces a very low resistance conduction path, i.e., a spark or arc, through the insulating gas and transfers a high energy electrical pulse to a load. Losses in the spark release large amounts of energy in various forms during each pulse. Besides the light energy produced by the spark, significant amounts of thermal energy are also produced. In addition, the rapid temperature and pressure change of the gas in the spark results in a series of very strong shock and expansion waves that propagate outwardly from the spark gap.

Before the spark gap has recovered and can hold the high voltage of another high-energy pulse, the gas between the electrodes must be returned to approximately its initial state or replaced with fresh gas. One way to rapidly restore the density of the gas in the spark gap is to introduce a gaseous purge flow which sweeps the hot residue produced by preceding sparks out of the spark gap and introduces a new charge of the gas into the spark gap and adjacent regions. In addition, pressure waves must also be controlled to restore the density of the fresh purge gas to the original density.

While such purging methods are effective, it can take a great deal of power to circulate the gaseous purge fluid flow. The flow power ($P_f$) required to circulate a gaseous purge fluid is given by the following formula:

$$P_f = K\rho A\,(\Delta x)^3(PRF)^3,$$

where $\rho$ is the medium density, PRF is the pulse repetition frequency, A is the spark gap flow channel cross sectional area, $\Delta x$ is the flushing distance, and K is a constant of proportionality.

It can be observed that the flow power is proportional to the third power of the PRF. As shown in the table below, for a reasonably sized spark gap (2 cm), the flow power becomes a significant fraction of the electrical power ($P_s$) transferred by the spark gap for pulse repetition frequencies of approximately 10 kHz or higher (see column labeled "$P_f/P_s$"). The data shown in the table are based on the assumption that the gaseous purge fluid was subsonic throughout the purge flow loop, and that there are no inefficiencies in generating flow power from a power source.

For high pulse energies and high-power switching, the flow velocity will approach the sonic velocity at pulse rates in the 5 to 15 kHz range and the flow losses will increase even more dramatically than indicated in the table. The table assumes 5 J/pulse loss due to 15% switch energy loss in 2×4 cm spark channel with a flushing distance of 2 cm.

TABLE

| PRF (Hz) | $P_f$(W) | $P_f/P_s$ |
|---|---|---|
| 1 | 0 | 0 |
| 10 | 0 | 0 |
| 100 | 0.08 | 0 |
| $10^3$ | 76 | $2 \times 10^{-3}$ |
| $10^4$ | $7.6 \times 10^{-4}$ | 0.23 |

Spark gap purge systems that use gaseous purge fluids are required to have either large equipment of the type needed to circulate gases or pressurized containers of the gaseous purge fluids, or both. In addition, the specialized equipment needed to handle and circulate gases is heavier than that needed to handle and circulate liquids.

Some pulsed power systems are intended only for intermittent operation. It is therefore wasteful of electrical energy to have a purge fluid circulation system that is either continually operating or incurs large energy penalties to bring the system into operation when needed.

High pressure gas storage has been the conventional means for supply insulating gas for intermittently operated high power gas purged equipment. For high power switches which are used intermittently or in a burst mode in space or aircraft applications, high pressure gas storage is a significant hazard. Failure of the storage vessel has the potential for destroying the entire vehicle. Storage of a condensable dielectric in the liquid phase can be done at low pressure. The liquid storage vessel will typically be approximately one tenth the volume of a high pressure gas storage vessel with comparable capacity to supply purge flow. Thus, a liquid state source of purged gas flow simultaneously provides a low hazard and compact means of providing dielectric purge gas to a high power spark gas.

It is therefore desirable to have a lightweight, compact spark channel purge system that can operate without requiring significant power input to circulate a gaseous purge fluid. It is also desirable to have a spark channel purge system that can be efficiently operated in an intermittent mode.

DISCLOSURE OF THE INVENTION

It is an object of the present invention to provide a spark channel purge system that has low circulation power requirements.

It is another object of the present invention to provide a spark channel purge system that uses a purge fluid that can exist in liquid and gas phases.

It is another object of this invention to use the normally wasted energy which is dissipated in the spark to provide the power to change the liquid phase to a gaseous dielectric which is used to purge the spark gap.

It is yet another object of the present invention to provide a spark channel purge system that is smaller than an equivalent flow spark channel purge system that uses a fully gaseous purge fluid.

It is a still further object of the present invention to provide a spark channel purge system that is lighter than such a spark channel purge system that uses a fully gaseous purge fluid.

Yet another object of the present invention is to provide a purge fluid system that can be used for intermittent operation.

A still further object of the present invention is to provide a purge fluid system utilizing a two-phase purge fluid in a spark gap switch.

According to one aspect, the invention provides a spark channel purge system for a spark gap switch that includes a purge fluid having a liquid state and a gaseous state. The purge system also includes a spark gap flow channel having an inlet and an outlet and adapted to receive the purge fluid at the inlet and to conduct the purge fluid to the outlet. In addition, the purge system includes a purge fluid source means for supplying the purge fluid in its liquid state. Further, this aspect of the invention includes a first heat exchanger means connected to the purge fluid source means and the inlet and the outlet of the spark gap for exchanging heat from the purge fluid flowing from the outlet of the spark channel to the purge fluid supplied by the purge fluid source means. The heat exchanger means also causes at least a portion of the liquid purge fluid to change to the gaseous state and supplies the purge fluid to the inlet of the spark channel, with at least a portion of the purge fluid being in the gaseous state.

In another aspect, the present invention provides a spark gap flow channel purge system for a spark gap switch that includes a purge fluid having a liquid state and a gaseous state. The purge system also includes a spark channel having an inlet and an outlet and adapted to receive the purge fluid at the inlet and to conduct the purge fluid to the outlet. In addition, the purge system includes a purge fluid source means for supplying the purge fluid in its liquid state. The purge system further includes a first heat exchanger means connected to the purge fluid source means and the inlet and the outlet of the spark channel for exchanging heat from the purge fluid flowing from the outlet of the spark channel to the purge fluid supplied by the purge fluid source means. The first heat exchanger means also causes at least a portion of the liquid purge fluid to change to the gaseous state and supplies the purge fluid to the inlet of the spark channel, at least a portion of the purge fluid being in the gaseous state. Finally, the first heat exchanger causes the purge flow supplied through the flow control means to be a mixture of the gaseous phase of the purge fluid and droplets of the liquid phase of the purge fluid. In alternative embodiments, the first heat exchanger may be provided internally to the spark channel to use additional waste energy from the spark to cause additional phase changes from liquid to gaseous dielectric.

Further according to this aspect of the invention, the purge system also includes a recirculation means connected to the first heat exchanger means for condensing the purge fluid flowing from the outlet of the spark channel to the liquid state and recirculating the liquid purge fluid to the purge fluid source means. The recirculation means comprises a second heat exchanger means for removing sufficient heat from the purge fluid received from the first heat exchanger means to cause the purge fluid to be condensed to the liquid state. The heat removed from the purge fluid is exchanged to a condensing coolant. In addition, the recirculation means includes pump means connected between the second heat exchanger means and the first heat exchanger means. The pump means can pump the liquid purge fluid from the second heat exchanger to the first heat exchanger means. Finally, the recirculation means includes flow control means connected between the first heat exchanger means and the inlet of the spark channel for controlling the amount of purge fluid flowing between the first heat exchanger means and the inlet of the spark channel.

BEST MODES FOR CARRYING OUT THE INVENTION

Figure 1:
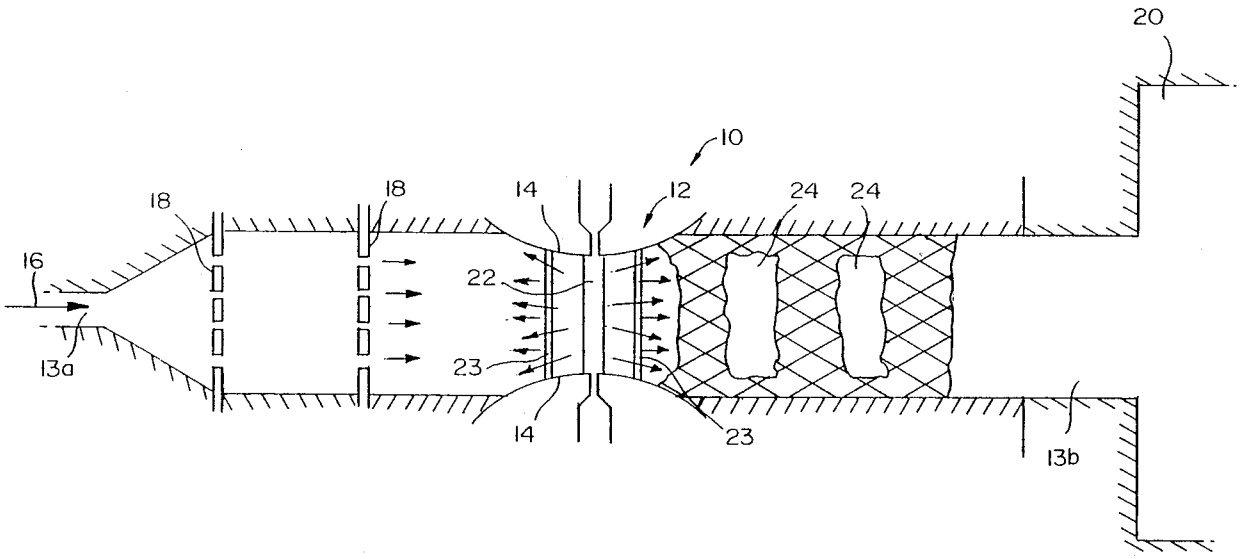
FIG. 1 is a schematic drawing of a plan view of a tuned, unsteady spark gap switch flow channel.

Referring to FIG. 1, the schematic diagram is a plan view of a tuned, unsteady flow, spark gap switch flow channel 10. The flow channel 10 includes a spark gap 12. The spark gap 12, having an inlet 13*a* and outlet 13*b*, includes a pair of electrodes 14 between which a high voltage is held when the pulsed power system of which the channel 10 is a part is operating. A purge flow, indicated by the arrow 16, of a gaseous purge fluid passes through the flow channel 10 and then through the spark gap 12 before passing to a diffuser duct 20.

When a spark is caused to occur between the electrodes 14 in the spark gap 12, a small volume of expanding plasma 22 is created in the spark gap 12. In addition, the spark creates a series of shock and expansion waves 23 and radiated energy that travels from the spark gap 12 both upstream and downstream in the flow channel 10. The shock waves that travel upstream generally disrupt the steady purge flow in prior art flow channels for a time after spark firing.

The expanding plasma 22 that is created by a spark in the spark gap 12 is carried downstream of the spark gap 12 by the average purge flow 16 of the gaseous purge fluid, producing a series of low-density, high-temperature pockets 24 of heated gas. In the absence of the flowing gaseous purge fluid, the high-temperature pockets 24 would remain in the vicinity of the spark gap 12, and undesirably and unpredictably affect the breakdown characteristics of the spark gap 12.

The pulse repetition frequency of the series of sparks in the spark gap 12 may be as high as 10 kilohertz or more. Accordingly, the purge flow 16 must pass through the spark gap 12 at velocities that are significant fractions of the sonic velocity, or possibly greater.

The hot gases contained in the low-density pockets 24 are typically swept downstream and through a heat exchanger 32 (see FIG. 2) where energy added by the spark, which may raise the local gas temperature to tens of thousands of degrees, is removed to a coolant stream. The gas then flows to a compressor 34 (see FIG. 2) where it is compressed and given the flow power needed to be recirculated around the flow loop that includes the flow channel 10. At high pulse rates, a second heat exchanger 36 (see FIG. 2) is generally used following the compressor to remove heat which is added due to compression work and compressor inefficiencies. A completely closed, gas recirculation system of this type has a relatively high compression work requirement at high pulse rates.

A description of a spark gap switch is given in copending U.S. patent application Ser. No. 256,430, entitled "Apparatus and Method for Tuned Unsteady Flow Purging of High Pulse Rate Spark Gaps," by the applicant of the present application, and assigned to the United States Department of Energy. That patent application is hereby incorporated into the present application by reference.

Figure 2:
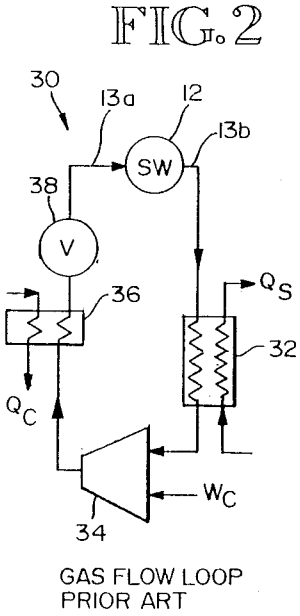
FIG. 2 is a schematic circuit diagram of a gas flow loop for a repetitively pulsed spark gap known in the prior art.

FIG. 2 is a schematic circuit diagram of a prior art gas flow loop 30 containing a wind tunnel-type flow channel. The gas flow loop 30 contains the spark gap 12, a first heat exchanger 32, a compressor 34, a second heat exchanger 36, and a flow control valve 38. The gaseous purge fluid flows through the components of the gas flow loop 30 in the order specified. The first heat exchanger 32 removes the heat ($Q_s$) added by the sparks in the spark gap 12, and the second heat exchanger 36 removes the heat ($Q_c$) added by the work done by the compressor 34. The flow control valve 38 or other means operates to regulate the volume of gas passing through the spark gap 12 of the gas flow loop 30.

Figure 3:
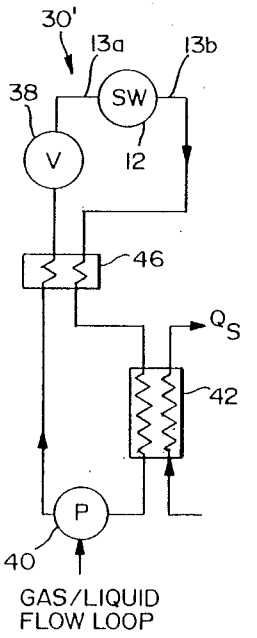
FIG. 3 is a schematic circuit diagram of a first embodiment of the present invention, showing a gas/liquid flow loop for purging the spark channel of a spark gap switch.
Figure 4:
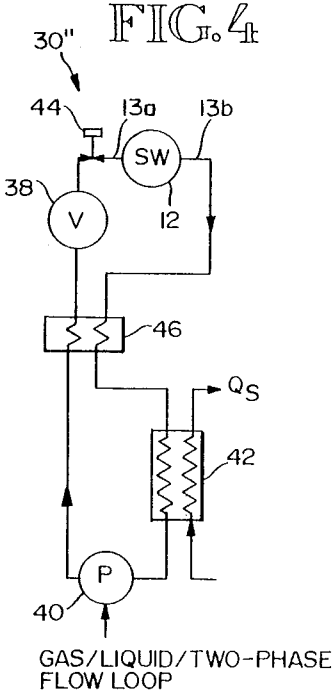
FIG. 4 is a schematic circuit diagram of a second embodiment of the present invention, showing a gas/-liquid/two-phase flow loop for purging the spark channel of a spark gap switch.

Alternate recirculation systems of the present invention utilize a liquid phase over the compression portion of the flow loop and a vapor or gas phase, or a mixture of gas and liquid or droplets, for the spark gap purging part of the flow loop. FIGS. 3 and 4 are schematic circuit diagrams of first and second embodiments of the present invention. FIG. 3 shows a gas/liquid flow loop 30', while FIG. 4 shows a gas/liquid/two-phase flow loop 30''. Further descriptions of such flow loops are given in copending U.S. patent application Ser. No. 256,839, entitled "Improved Spark Gap Switch System With Condensible Dielectric Gas," by the applicant of the present application and assigned to the United States Department of Energy. That application is hereby incorporated into the present application by reference. The types of components required in the flow loops 30' and 30'' of FIGS. 3 and 4 are analogous to those for the gas flow loop 30 of FIG. 2. However, a pump 40 is used instead of the compressor 34, and a condenser 42 is used instead of the first heat exchanger 32. In addition, the flow loops 30' and 30'' have a heat exchanger means 46 that supplies purge fluid to the valve 38 and receives the purge fluid after it passes through the spark gap 12. This heat exchanger means may alternatively be circulation of the return liquid through hot spark gap walls, electrodes, and other components heated by the spark and through the inlet portion of the spark gap, where radiated energy causes phase change. The gas/liquid/ two-phase flow loop 30'' of FIG. 4 may have one additional component not used in the flow loop 30' of FIG. 3. This component is a throttling valve 44 (or equivalent device) that is used to drop the pressure of the liquid leaving the flow control valve 38 to cause a phase change of the purge flow fluid from the liquid phase of the working fluid to a two-phase flow that includes the gaseous phase and droplets of the liquid phase.

The gas/liquid/two-phase flow loop 30'' of FIG. 4 potentially has a somewhat larger loop pressure loss than the gas/liquid cycle shown in FIG. 3, but it is still much more efficient than the gas flow loop 30 shown in FIG. 2. The reason is that the amount of work required to compress a liquid through the same pressure rise as the gas and to circulate the liquid around the flow loop 30'' is very much less than that to circulate the gas around the flow loop 30, due to the incompressibility of the liquid phase of the working fluid. If the relative power required to circulate the purge fluid in the gas system of FIG. 2 is 10,000 watts, the power required to circulate the same purge flow rate in the gas/liquid system of FIG. 3 is 13 watts. Under the same conditions, the flow power for the gas/liquid/two-phase system of FIG. 4 is 40 watts. These figures show the large advantage of the gas/liquid cycles shown in FIGS. 3 and 4 over the gas cycle shown in FIG. 2 for high pulse rate operation where the flow power becomes large relative to the electrical power. (These power comparisons have assumed a conventional wind tunnel approach, in which the flow energy generated by the spark discharge is not used to help purge the spark gap. The flow power required for the two-phase system of FIG. 4 will actually be less than the 40 watts discussed above.)

There is also a system size and weight advantage for the gas/liquid flow loops 30' and 30'' of FIGS. 3 and 4, in addition to the efficiency advantages. The pump 40, the condenser 42, and the liquid flow components are significantly smaller than the compressor 34 and the gas flow components.

Another advantage of the flow loops of FIGS. 3 and 4 is that the heat of the residual gases produced by the sparks in the spark gap 12 and passing through the outlet **13*b* of the spark gap 12 is exchanged through the heat exchanger 46 to the purge fluid liquid phase that is pumped to the first heat exchanger 46 by the pump 40. Therefore, wasted heat from the spark is used at the heat exchanger 46 to convert the purge fluid to its gaseous phase in the inlet of the gas/liquid flow loop 30' of FIG. 3. On the other hand, the purge fluid is partially converted to a two-phase fluid flow consisting of a mixture of the gaseous phase and droplets of the liquid phase in the inlet 13*a* of the gas/liquid/two-phase flow loop of FIG. 4. The heat exchanged in the condenser 42 (i.e., a heat exchanger) is taken by a coolant which can have its heat exchanged out elsewhere. Condenser 42** is a heat exchanger that removes enough heat from the fluid to convert it all to the liquid phase.

Figure 5:
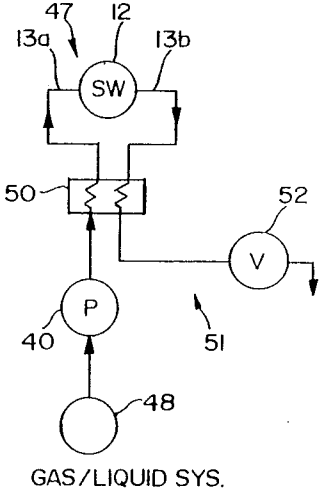
FIG. 5 is a schematic circuit diagram of a third embodiment of the present invention, showing a non-recirculating liquid/vapor flow loop for purging the spark channel of a spark gap switch.

Referring now to FIG. 5, a gas/liquid flow loop 47 is shown. It will be appreciated that the gas/liquid flow system 47 has very large advantages in intermittently operated, high-power systems that remain in a standby condition for long periods. One important example of such an application is a space-based laser system. These advantages derive primarily from the fact that the purge fluid can be stored in a dense liquid form in a low-pressure storage vessel 48 rather than as a compressed gas at a high pressure, as for conventional flow loop systems, such as flow loop 30 of FIG. 2. In the gas/liquid flow system 47 of FIG. 5, the purge fluid is exhausted from the system when the flow system 47 is operating. In addition to the low-pressure storage vessel 48 for storing the liquid phase of the purge fluid, the gas/liquid flow system 47 of FIG. 5 includes the pump 40, a storage heat source for start-up (not shown), a regenerative heat exchanger 50, and an exhaust system 51, including a back pressure control valve 52. The regenerative heat exchanger 50 exchanges the heat, introduced by the sparks in the spark gap 12 and passing through the outlet **13*b* of the spark gap 12 in the gaseous phase, to the liquid pumped from the low-pressure storage vessel 48 by the pump 40. This causes the purge fluid entering the inlet 13***a* to be in its gaseous phase or a mixture of liquid and gas. The exhaust system 51 exhausts the purge fluid, from which the heat has been removed by the heat exchanger 50, from the gas/liquid flow loop 47.

The best modes of the invention have been explained in the context of a high voltage, pulsed power system. One skilled in the art will readily appreciate that the spark gap switch can be used in other applications requiring the switching of large amounts of electrical power between two electrodes. It will be well understood by those skilled in the art that the spark gap switch disclosed in the FIGS. 2 through 5 of the present application can, where appropriate, be of the sort that is disclosed in copending U.S. patent application No. 257,286 applied in the name of the present applicant and entitled "Spark Gap Switch Having a Two-Phase Fluid Flow," now U.S. Pat. No. 4,931,687 issued on June 5, 1990 and assigned to the assignee of the present application. This U.S. patent application is hereby incorporated by reference.

While specific embodiments of the present invention have been discussed in the foregoing, those skilled in the art will readily appreciate that various modifications of the embodiments discussed can be made without departing from the spirit and scope of the present invention. The spirit and scope of the present invention are, accordingly, to be determined only by the following claims.

I claim:

1. A spark gap flow channel purge system for a spark gap switch, comprising:

a purge fluid capable of existing in a liquid phase and a gaseous phase;

a spark gap with a flow channel having an inlet and an outlet, the spark gap being adapted to receive the purge fluid at the inlet and to conduct the purge fluid to the outlet, at least a portion of the purge fluid received at the inlet being in the gaseous phase;

purge fluid source means for supplying the purge fluid in its liquid phase; and first heat exchanger means connected to the flow channel for exchanging heat from the spark gap to the purge fluid received from the purge fluid source means, for causing a phase change in the purge fluid so that at least a portion of the liquid purge fluid received from the purge fluid source means changes to the gaseous phase at the spark gap, and for supplying the partially gaseous purge fluid to the inlet of the flow channel.

2. A spark gap flow channel purge system for a spark gap switch, comprising:

a purge fluid capable of existing in a liquid phase and a gaseous phase;

a spark gap with a flow channel having an inlet and an outlet, the flow channel being adapted to receive the purge fluid at the inlet and to conduct the purge fluid to the outlet, at least a portion of the purge fluid received at the inlet being in the gaseous phase;

purge fluid source means for supplying the purge fluid in its liquid phase; and first heat exchanger means for receiving the purge liquid from the outlet of the spark gap flow channel and receiving the purge fluid from the purge fluid source means prior to delivery to the inlet of the spark gap flow channel, for exchanging heat from the purge fluid received from the outlet of the flow channel to the purge fluid received from the purge fluid source means, for causing a phase change so that at least a portion of the liquid purge fluid received from the purge fluid source means changes to the gaseous phase at the spark gap, and for supplying the partially gaseous purge fluid to the inlet of the flow channel.

3. The spark gap flow channel purge system of claim 2, further comprising exhaust means connected to the first heat exchanger means for exhausting from the system the purge fluid flowing from the outlet of the flow channel after being received by the first heat exchanger means.

4. The spark gap flow channel purge system of claim 3 wherein the purge fluid source means comprises a storage vessel for the purge fluid in the liquid phase and a pump connected between the storage vessel and the first heat exchanger means and the pump being operable to pump the purge fluid in the liquid phase from the storage vessel to the first heat exchanger means.

5. The spark gap flow channel purge system of claim 2, further comprising recirculation means for receiving from the first heat exchanger means the purge fluid received thereby from the outlet of the flow channel, and for condensing the purge fluid to the liquid phase and a pump for recirculating the liquid purge fluid to the purge fluid source means.

6. The spark gap flow channel purge system of claim 5 wherein the recirculation means comprises second heat exchanger means for removing sufficient heat from the purge fluid received from the first heat exchanger means to condense the purge fluid to the liquid phase.

7. The spark gap flow channel purge system of claim 6 wherein the recirculation means further comprises pump means for receiving the liquid purge fluid from the second heat exchanger means and for pumping the liquid purge fluid from the second heat exchanger means to the first heat exchanger means.

8. The spark gap flow channel purge system of claim 7, further comprising flow control means for receiving the liquid or partially gaseous purge fluid from the first heat exchanger means and supplying the partially gaseous purge fluid to the inlet of the flow channel, and for controlling the amount of partially gaseous purge fluid flowing between the first heat exchanger means and the inlet of the flow channel.

9. The spark gap flow channel purge system of claim 8 wherein the first heat exchanger means further causes the liquid or partially gaseous purge flow supplied to the flow control means to be a mixture of the gaseous phase of the purge fluid and droplets of the liquid phase of the purge fluid at the spark gap flow channel inlet.

10. The spark gap flow channel purge system of claim 8 wherein the flow control means further causes the liquid or partially gaseous purge flow to be a mixture of the gaseous phase of the purge fluid and droplets of the liquid phase of the purge fluid at the spark gap flow channel inlet.

11. The spark gap flow channel purge system of claim 8, further comprising throttle means for receiving liquid or the partially gaseous purge fluid from the flow control means and supplying the partially gaseous purge fluid to the inlet of the flow channel, and for causing the partially gaseous purge fluid flow controlled by the flow control means to be a mixture of the gaseous phase of the purge fluid and droplets of the liquid phase of the purge fluid.

12. A spark gap flow channel purge system for a spark gap switch having a spark gap, comprising:

a purge fluid capable of existing in a liquid phase and a gaseous phase;

a spark gap with a flow channel having an inlet and an outlet, the flow channel being heated by the energy released by the spark in the spark gap and being adapted to receive the purge fluid at the inlet and to conduct the purge fluid to the outlet, at least a portion of the purge fluid received at the inlet being in the gaseous phase;

purge fluid source means for supplying the purge fluid in its liquid phase; and first heat exchanger means connected to the flow channel for exchanging heat from the flow channel to the purge fluid received from the purge fluid source means, for causing a phase change so that at least a portion of the liquid purge fluid received from the purge fluid source means will be in the gaseous phase, and for supplying the partially gaseous purge fluid to the inlet of the flow channel.

13. The spark gap flow channel purge system of claim 12 wherein the purge fluid source means comprises a storage vessel for the purge fluid in the liquid phase and a pump connected between the storage vessel and the first heat exchanger means, the pump means being operable to pump the purge fluid in the liquid phase from the storage vessel to the first heat exchanger means.

14. A spark gap flow channel purge system for a spark gap switch, comprising:

a purge fluid capable of existing in a liquid phase and a gaseous phase;

a spark gap with a flow channel having an inlet and an outlet, the flow channel being adapted to receive the purge fluid at the inlet and to conduct the purge fluid to the outlet, at least a portion of the purge fluid received at the inlet being in the gaseous phase;

purge fluid source means for supplying the purge fluid in its liquid phase, comprising a storage vessel for the purge fluid in the liquid phase and pump means connected to the storage vessel, the pump means being operable to pump the purge fluid in the liquid phase from the storage vessel;

first heat exchanger means for receiving the purge fluid from the outlet of the flow channel and receiving the purge fluid from the purge fluid source means, for exchanging heat from the purge fluid received from the outlet of the flow channel to the purge fluid received from the purge fluid source means, for causing phase change so that at least a portion of the liquid purge fluid received from the purge fluid source means will be in the gaseous phase, and for supplying the partially gaseous purge fluid to the inlet of the flow channel;

exhaust means connected to the first heat exchanger means for exhausting the purge fluid received by the first heat exchanger from the outlet of the flow channel; and a back pressure control valve connected to the exhaust means for controlling the back pressure the exhaust means presents to the first heat exchanger.

15. A spark gap flow channel purge system for a spark gap switch, comprising:

a purge fluid capable of existing in a liquid phase and a gaseous phase;

a spark gap with a flow channel having an inlet and an outlet, the flow channel being adapted to receive the purge fluid at the inlet and to conduct the purge fluid to the outlet, at least a portion of the purge fluid received at the inlet being in the gaseous phase;

purge fluid source means for supplying the purge fluid in its liquid phase;

first heat exchanger means for receiving the purge fluid from the outlet of the flow channel and receiving the purge fluid from the purge fluid source means, for exchanging heat from the spark gap or from the purge fluid received from the outlet of the flow channel to the liquid purge fluid received from the purge fluid source means, for causing at least a portion of the liquid purge fluid received from the purge fluid source means to change to the gaseous phase, and for supplying the partially gaseous purge fluid to the spark gap; and recirculation means connected to the first heat exchanger means for condensing the purge fluid flowing from the outlet of the flow channel to the liquid phase and for recirculating the liquid purge fluid to the purge fluid source means, the recirculation means comprising:

second heat exchanger means for removing sufficient heat from the purge fluid flowing from the first heat exchanger means to cause the purge fluid to be condensed to the liquid phase, the heat removed from the purge fluid being exchanged to a condensing coolant, pump means connected between the second heat exchanger means and the first heat exchanger means, the pump means being operable to pump the liquid purge fluid from the second heat exchanger means to the first heat exchanger means, and flow control means connected between the first heat exchanger means and the spark gap, for controlling the amount of purge fluid flowing between the first heat exchanger means and the spark gap.

16. The spark gap flow channel purge system of claim 15 wherein the flow control means further causes the purge flow whose amount is controlled between the first heat exchanger means and the spark gap to be a mixture of the gaseous phase of the purge fluid and droplets of the liquid phase of the purge fluid.

17. The spark gap flow channel purge system of claim 15, further comprising throttle means connected between flow control means and the spark gap for causing the fluid flow controlled by the flow control means to be a mixture of the gaseous phase of the purge fluid and droplets of the liquid phase of the purge fluid.

18. A spark gap flow channel purge system for a spark gap switch, comprising:

a purge fluid capable of existing in a liquid phase and a gaseous phase;

a spark gap with a flow channel having an inlet and an outlet, the flow channel being adapted to receive the purge fluid at the inlet and to conduct the purge fluid to the outlet, at least a portion of the purge fluid received at the inlet being in the gaseous phase;

purge fluid source means for supplying the purge fluid in its liquid phase;

first heat exchanger means connected to the purge fluid source means and to the flow channel for exchanging heat from the flow channel to the purge fluid received from the purge fluid source means, for causing at least a portion of the liquid purge fluid received from the purge fluid source means to change to the gaseous phase, for supplying the partially gaseous purge fluid to the inlet of the flow channel; and recirculation means connected to the first heat exchanger means for condensing the purge fluid flowing from the outlet of the flow channel to the liquid phase and recirculating the liquid purge fluid to the purge fluid source means, the recirculation means comprising:

a second heat exchanger means for removing sufficient heat from the purge fluid received from the first heat exchanger means to cause the purge fluid to be condensed to the liquid phase, the heat removed from the purge fluid being exchanged to a condensing coolant, pump means connected between the second heat exchanger means and the first heat exchanger means, the pump means being operable to pump the liquid purge fluid from the second heat exchanger to the first heat exchanger means, and flow control means connected between the first heat exchanger means and the inlet of the flow channel, for controlling the amount of purge fluid flowing between the first heat exchanger means and the inlet of the flow channel.

19. The spark gap flow channel purge system of claim 18 wherein the flow control means further causes the purge flow to be a mixture of the gaseous phase of the purge fluid and droplets of the liquid phase of the purge fluid.

20. The spark gap flow channel purge system of claim 18, further comprising throttle means connected between flow control means and the inlet of the flow channel for causing the fluid flow controlled by the flow control means to be a mixture of the gaseous phase of the purge fluid and droplets of the liquid phase of the purge fluid.

21. The spark gap flow channel purge system of claim 1 wherein the spark gap further comprises means for mixing the two phases of the purge fluid in the flow channel and for causing the mixed purge fluid to absorb energy from the spark gap.

22. The spark gap flow channel purge system of claim 21 wherein the spark gap further comprises means for causing the mixed purge fluid to circulate in the flow channel.

* * * * *